US005414987A

United States Patent [19]

Knoff et al.

[11] Patent Number: 5,414,987

[45] Date of Patent: May 16, 1995

[54] PRE-STUFFER BOX CONDITIONING OF PLY-TWISTED CARPET YARN

[75] Inventors: Warren F. Knoff, Richmond; Theresa A. Weston, Charlottesville, both of Va.

[73] Assignee: E. I. Du Pont de Nemours and Company, Wilmington, Del.

[21] Appl. No.: 129,613

[22] Filed: Sep. 30, 1993

Related U.S. Application Data

[63] Continuation-in-part of Ser. No. 733,353, Jul. 17, 1991, abandoned.

[51] Int. Cl.[6] ..... D02J 11/00; D02G 1/20

[52] U.S. Cl. ..... 57/282; 28/221; 28/265; 57/205; 57/208; 57/239; 57/283

[58] Field of Search ..... 28/221, 247, 262, 263, 28/265; 57/205, 208, 236, 238, 239, 282, 283

[56] References Cited

U.S. PATENT DOCUMENTS

| | | | |
|---|---|---|---|
| 3,044,145 | 10/1958 | Tager et al. | 28/1 |
| 3,380,131 | 4/1968 | Gray | 28/221 X |
| 3,593,395 | 7/1971 | Stanley | 28/221 |
| 3,745,061 | 7/1973 | Champaneria et al. | 161/178 |
| 3,816,583 | 3/1974 | Kashima et al. | 264/282 |
| 3,831,368 | 8/1974 | Glowacki | 57/140 BY |
| 3,965,547 | 6/1976 | Ferrier et al. | 28/1.3 |
| 3,972,176 | 8/1976 | Lawson, Jr. et al. | 57/157 TS |
| 3,985,089 | 10/1976 | Yacono | 112/266 |
| 4,188,691 | 2/1980 | Matsumoto et al. | 28/255 |
| 4,290,378 | 9/1981 | Wilkie | 112/410 |
| 4,295,252 | 10/1981 | Robinson et al. | 28/248 |
| 4,408,446 | 10/1983 | Wilkie | 57/246 |
| 4,472,481 | 9/1984 | Snooks, Jr. et al. | 428/362 |
| 4,492,731 | 1/1985 | Bankar et al. | 428/362 |
| 4,779,408 | 10/1988 | Nelson | 57/284 |
| 4,870,813 | 10/1989 | Nelson | 57/204 |
| 4,912,821 | 4/1990 | Mutsuo | 28/263 X |
| 5,054,173 | 10/1991 | Schafer | 28/263 |
| 5,233,736 | 8/1993 | Hill | 28/221 X |

FOREIGN PATENT DOCUMENTS

| | | |
|---|---|---|
| 013829 | 12/1979 | European Pat. Off. . |
| 043091A2 | 11/1990 | European Pat. Off. . |
| 45-3001 | 4/1965 | Japan . |

OTHER PUBLICATIONS

B. M. Chapman, "The Bending Stress–Strain Properties of Single Fibres and the Effect of Temperature and Relative Humidity", *Journal of Textile Institute*, 1963–64, No. 6, pp. 312–327.

*Primary Examiner*—Daniel P. Stodola
*Assistant Examiner*—William Stryjewski

[57] ABSTRACT

A process for treating a ply-twisted crimped multifilament yarn. The process involves adjusting the temperature and moisture content of the yarn prior to passing the yarn through a stuffer box which is essentially free of steam. Excess hot fluid is removed from the yarn, and the yarn's temperature is adjusted to a temperature in the range of about 40° to 90° C. before the yarn is passed through the stuffer box. The yarns may be used for making a textured saxony-type carpets having a tightly tailored surface texture.

9 Claims, 4 Drawing Sheets

PRE-STUFFER BOX CONDITIONING OF PLY-TWISTED CARPET YARN

CROSS-REFERENCES TO RELATED APPLICATIONS

This application is a continuation-in-part of application Ser. No. 07/733,353 filed on Jul. 17, 1991, now abandoned.

BACKGROUND OF THE INVENTION

1. Field of the Invention

The present invention relates to an improved process for treating a ply-twisted crimped multifilament yarn. More particularly, the process involves adjusting the temperature and moisture content of the yarn prior to passing the yarn through a stuffing chamber. These yarns are especially suitable for producing textured saxony-type carpets having a tightly tailored surface texture.

2. Description of the Related Art

A large portion of carpets used in residences are known as cut pile carpets which include saxony-type carpets. In saxony-type carpets, heat-set, ply-twisted pile yarn is inserted into a backing material as loops which are then cut to form vertical tufts. The tufts are then evenly sheared to a desired height which is typically about 0.4 to 0.7 inches. Generally, there are two different styles of saxony-type carpets: 1) a straight-set style in which the filaments at the tuft tip are straight and substantially perpendicular to the plane of the carpet face, and 2) a textured style in which the tufts and the individual filaments have varying degrees of curl.

Yarn which is used as pile in textured saxony-type carpets is prepared by cabling together two or more singles yarns, heat-setting them in their twisted condition, and finally drying them. One known method of processing the ply-twisted yarn involves feeding the yarn through a stuffing chamber and then passing the yarn through a continuous heat-setting machine known as a Superba® which treats the yarn with pressurized saturated steam to heat-set the twist. The yarn is axially compressed within the stuffing chamber. Another known method involves feeding the ply-twisted yarn through the stuffing chamber and then passing it through a continuous heat-setting machine known as a Suessen which treats the yarn with dry heat to heat-set the twist. The yarn is tufted into a carpet backing material, and the carpet is subjected to standard dyeing and finishing operations including stain and soil resist treatment.

Depending upon the twist level of the yarns and other factors, textured saxony-type carpets may exhibit different surface textures. For example, a frieze carpet is made from pile yarns having a "high ply-twist". By the term "high ply-twist" as used herein, it is meant a ply-twist level of greater than about 5.5 turns per inch (tpi). When such yarn is processed and then tufted into a backing material, the resulting carpet tufts are highly kinked and curled. This gross buckling of the tuft structure gives the carpet a distinct texture.

In other instances, textured saxony-type carpets may have a looser surface texture, where the tips of the tufts are splayed open and the carpet surface has a brush-like appearance. This type of texture is similar to the texture of a straight-set saxony-type carpet. Generally, these carpets are made from "low ply-twist" pile yarns. By the term "low ply-twist" as used herein, it is meant a ply-twist level of less than about 4.25 turns per inch (tpi).

Other textured saxony-type carpets containing low ply-twist pile yarns have a poodle-like surface texture, where many of the tufts have an initial unraveled structure. These carpets may also be referred to as being overtextured. Often, the yarns for these carpets are processed by injecting steam directly into the stuffing chamber as the yarn passes through the chamber.

Another type of desirable surface texture is referred to as a "tightly tailored" texture. By the term "tightly tailored" as used herein, it is meant a surface texture characterized by substantially straight and unkinked tufts having a tightly twisted structure, with high twist integrity. The tuft tips are substantially unopened and have compact helical curls, and the tuft structures do not demonstrate gross buckling. Such carpets may also be referred to as "trackless" carpets, since they tend to show reduced footprints and vacuum cleaning marks.

In the past, high ply-twist nylon 6 and nylon 6,6 yarns were typically used to achieve this tightly tailored appearance. However, the need for initial higher twisting in the yarns makes these yarn manufacturing processes slow and less economically viable.

Now, in accordance with this invention, it has been found that textured saxony-type carpets having a tightly tailored surface texture may be prepared from nylon 6,6 yarns having lower twist levels than nylon 6,6 yarns used in the past. These carpets are prepared from yarns produced by the unique process of this invention.

SUMMARY OF THE INVENTION

The present invention relates to an improved process for treating a ply-twisted crimped multifilament yarn. The process involves impinging the ply-twisted yarn with a heated fluid, such as saturated or dry steam, in order that the yarn becomes saturated with water and is heated. Excess heated fluid is then removed from the yarn and the yarn is passed through a stuffing chamber which is essentially free of steam. Particularly, the temperature of the yarn is in the range of about 40° to 90° C. immediately prior to being passed through the stuffing chamber. Inside the stuffing chamber, the yarn is axially compressed.

The process of this invention further includes the step of passing the ply-twisted yarn through a heat-setting chamber subsequent to passing the yarn through the stuffing chamber. The heat-setting chamber provides for heat-setting of the twist in the yarn. Preferably, pressurized saturated steam or dry heat is used to heat-set the twist. The process may be used to treat bulked continuous multifilament yarns and staple spun yarn, particularly nylon 6,6 yarns. These yarns are especially suitable for producing textured saxony-type carpets having a tightly tailored surface texture.

DETAILED DESCRIPTION OF THE INVENTION

Figure 1:
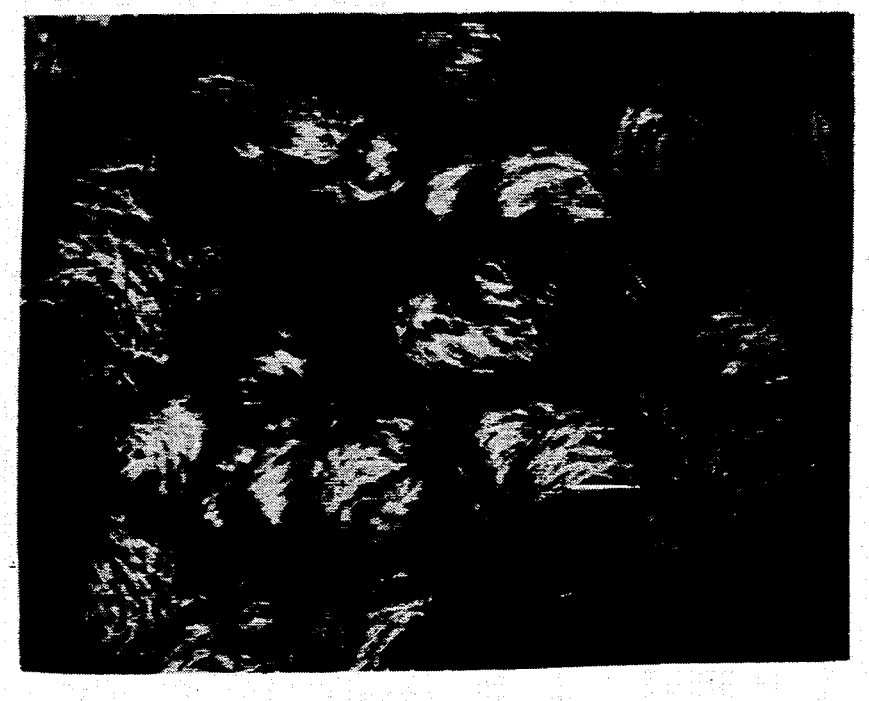
FIG. 1 is a face view of a carpet having a frieze surface texture and a Visual Rating of 1.

The present invention relates to an improved process for treating a "ply-twisted crimped multifilament yarn." By the term "ply-twisted crimped multifilament yarn", it is meant a crimped multifilament yarn constructed by cabling together two or more singles yarns either by a two step twisting/cabling process or a direct cabling process, both of which are familiar to those skilled in the art. Preferably, the ply-twisted yarn is composed of bulked continuous filament (BCF) yarns, but staple spun yarns may also be used. These BCF and staple component yarns may be manufactured in the following general manner.

The BCF and staple yarn contain filaments prepared from synthetic thermoplastic polymers such as polyamides, polyesters, polyolefins, and acrylonitriles. Polyamides, such as polyhexamethylene adipamide (nylon 6,6) and polycaprolactam (nylon 6), are especially suitable. Copolyamides containing at least 80% by weight of hexamethylene adipamide units and one or more different amide units made from amide forming moieties such as 2-methyl-pentamethylenediamine (MPMD), caprolactam, dodecanedioic acid, isophthalic acid, etc. are also suitable. These copolyamides may be true copolymers (random or block) or melt blends.

Typically in a nylon filament manufacturing process, the molten polymer is extruded through a spinneret into a quench chimney where chilled air is blown against the newly formed hot filaments. The filament's cross-sectional shape is dependent upon the design of the spinneret. Preferably, the filament has a trilobal cross-section with a modification ratio (MR) of less than about 2.4. The filament may even contain voids extending through its axial core, as described in Champaneria et al., U.S. Pat. No. 3,745,061. The filaments are pulled through the quench zone by means of feed roll and treated with a spin-draw finish from a finish applicator. The filaments are then passed over heated draw rolls. Subsequently, the filaments may be crimped to make bulked continuous filaments (BCF). Alternatively, the filaments may be crimped and cut into short lengths to make staple fiber. Hot air jet-bulking methods, as described in Breen and Lauterbach, U.S. Pat. No. 3,186,155, may be employed to bulk the yarn. Generally, for purposes of this invention, each yarn has a bulk crimp elongation (BCE) of about 10 to 45%, preferably greater than 30%, and a denier per filament (dpf) of about 10 to 20. The yarns may then be ply-twisted together and subjected to a heat-setting operation.

As mentioned above, the yarns may be ply-twisted together using a direct cabling process. Typically in a direct cabling process, one yarn(s) is fed from a creel through a tensioning device and onto a spinning disc from which it emerges to form a "ballooning yarn". A second yarn is fed from a stationary bucket through a tensioning device and combines with the creel yarn to form a ply-twisted yarn. For purposes of this invention, it is preferable that the total denier of the ply-twisted yarn be in the range of about 2000 to 4000.

Those skilled in the art are familiar with the following general methods used to treat a ply-twisted yarn in order that such yarns may be used for making a textured saxony-type carpet, and these methods may be used in accordance with the present invention.

Initially, the multifilament yarn is fed through a stuffing chamber such as a stuffer box, wherein the yarn is axially compressed. The stuffer box typically includes two friction feed rolls which force the yarn into a cavity, while a restrained gate exerts rearward pressure on the yarn. The operating conditions for the stuffer box including gate pressure are adjusted accordingly.

The multifilament yarn may then pass through a continuous heat-setting machine known as a Superba®. Generally, in such an operation, the multifilament yarn is placed onto a conveyer belt which first moves through an atmospheric steam pre-bulking chamber and then through a heat-setting chamber. In the pre-bulking chamber, the yarn is heat-relaxed in order to develop bulk in the yarn. In the heat-setting chamber, the yarn is treated with pressurized saturated steam to heat-set the twist and mechanically stabilize the yarn structure. For nylon 6,6 multifilament yarns, the temperature is generally in the range of about 125° to 135° C. The bulked, multifilament yarn is then dried.

Alternatively, the multifilament yarn may pass through a continuous heat-setting machine known as a Suessen. The Suessen treats the yarn with dry heat to heat-set the twist. For nylon 6,6 multifilament yarns, the temperature is generally in the range of about 185° to 205° C.

The multifilament pile yarn is then tufted into the backing of a carpet. The carpet is then typically dyed and subjected to other standard finishing operations including stain and soil resist treatment followed by shearing of the tufts.

The essence of the present invention involves conditioning the yarn in a specific manner before the yarn enters the stuffing chamber. The yarn is first impinged with a heated fluid such that the yarn is saturated with water and heated By the term "saturated", it is meant that there is water present in excess of that which will be actually absorbed into the filaments. For nylon 6,6, this corresponds to greater than approximately 9% water by weight based on the dry weight of the yarn. It is believed that increasing the temperature and moisture content of the yarn immediately before the yarn enters the stuffing chamber causes the yarn to more permanently accept the deformation imparted by the stuffing chamber. Particularly, it is believed that the bending modulus and recovery of the individual filaments are changed with such treatment. Suitable heated fluids for treating the yarn include dry steam and saturated steam. Steam is preferably used for treating nylon yarns, since this allows the yarn to be saturated and heated simultaneously.

Figure 7:
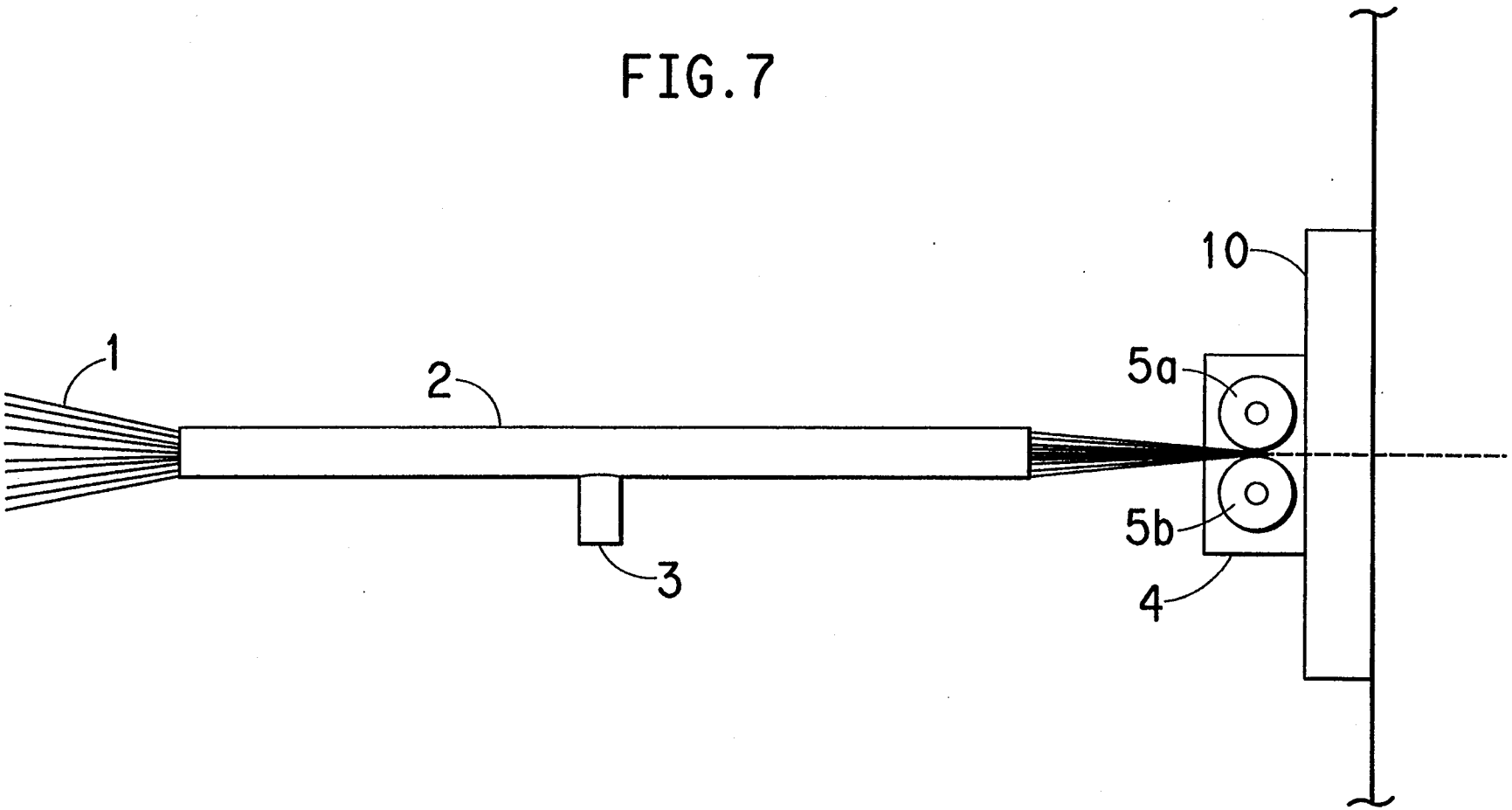
FIG. 7 is a side view of a steam tube used in the process of this invention.

One means for treating the yarn with steam is shown in FIG. 7. Referring to FIG. 7, the multifilament yarn (1) is fed into a steam tube (2). The steam tube is insulated and includes a steam inlet (3). Steam is supplied to the tube by an insulated steam line. The length of the tube is sufficient such that there is enough time to uniformly heat and saturate the bundle of ply-twisted yarns. The inside diameter of the tube is approximately the same diameter of the loosely consolidated bundle of yarns to be conditioned. As the yarn exits the steam tube (2), it is important that excess steam be removed from the yarn before the yarn is introduced into the stuffer box (10) at inlet (4). The temperature of the yarn immediately before the yarn is introduced into the stuffer box should be in the range of about 40° to 90° C. Although excess steam is removed from the yarn before it is fed into the stuffer box, it is important that the yarn remains saturated. As discussed above, it is believed that saturation of the yarn allows it to be axially compressed in a unique manner.

In the operation illustrated in FIG. 7, the stuffing chamber is adjacent to but decoupled from the steam tube. Thus, excess steam is sufficiently removed from the yarn by passing the yarn through this exposed area between the steam tube and stuffer box at room temperature, where excess steam is vented into the atmosphere. Generally in such an arrangement, the distance between the steam tube and stuffer box can be in the range of about one to ten inches. In a preferred operation, excess steam is removed by a vacuum evacuation chamber located between the steam tube and stuffer box.

The yarn is then passed through the stuffing chamber which is essentially free of steam. It is recognized that trace amounts of steam may be inadvertently present in the stuffing chamber due to the adjacent steam tube and steam treatment of the yarn, but no steam should be introduced directly into the stuffing chamber. In addition, the steam should not be used to advance or direct the yarn into the stuffing chamber, rather the yarn should be fed through the process via mechanical means, such as the feed rolls (5*a*) and (5*b*) shown in FIG. 7. If steam is injected into the stuffing chamber, the yarn structure and corresponding carpet surface texture are adversely affected, as shown in the following comparative examples. The steam tube, shown in FIG. 7, is one example of a suitable device for practicing this invention. However, it is recognized that those skilled in the art will be aware of other suitable devices.

The process of this invention provides new multifilament yarns which can be tufted into carpets by techniques known in the art. A particularly desirable multifilament yarn made from the process of this invention is characterized by having a ply-twist level between about 3 to 6 turns per inch (tpi). More preferably, the yarn has a ply-twist level between about 3 to 5 tpi. Preferably, the multifilament yarn is a nylon yarn and more preferably it is nylon 6,6.

Figure 3:
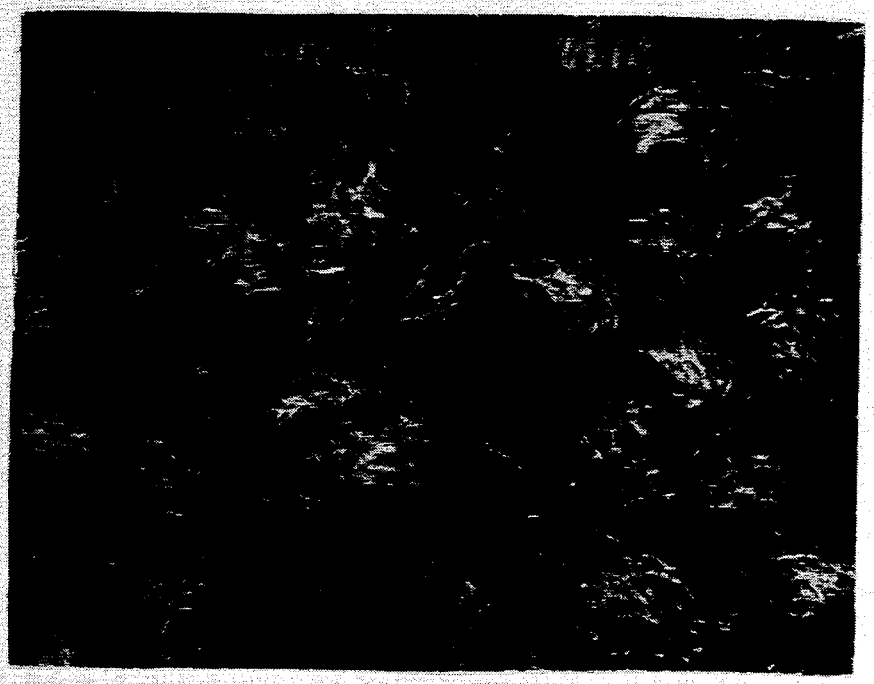
FIG. 3 is a face view of a carpet of the present invention having a tightly tailored surface texture, and a Visual Rating of 3.
Figure 4:
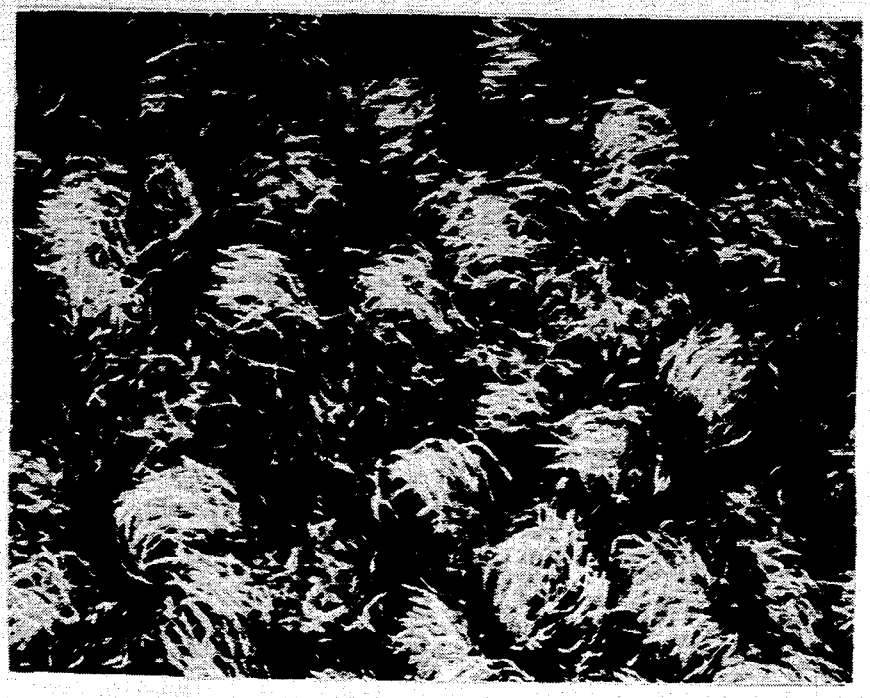
FIG. 4 is a face view of a carpet of the present invention having a tightly tailored surface texture, and a Visual Rating of 4.

When such yarns are tufted into carpets, they provide a distinctive tightly tailored surface texture to the carpet, as shown in FIGS. 3 and 4. These textured saxony-type carpets have respective ratings of 3 and 4 on the Visual Rating Scale. As previously described, the tightly tailored surface texture is characterized by substantially straight and unkinked tufts having a tightly twisted structure with high twist integrity. The tuft tips are substantially unopened and have compact helical curls, and the tuft structures do not demonstrate gross buckling. Rather, the tuft structures have axial compression deformations, similar to the compression of a helical spring. This is due to helical compression deformations being imparted into the filaments as the ply-twisted yarn is passed through the stuffing chamber in accordance with the process of this invention.

Figure 2:
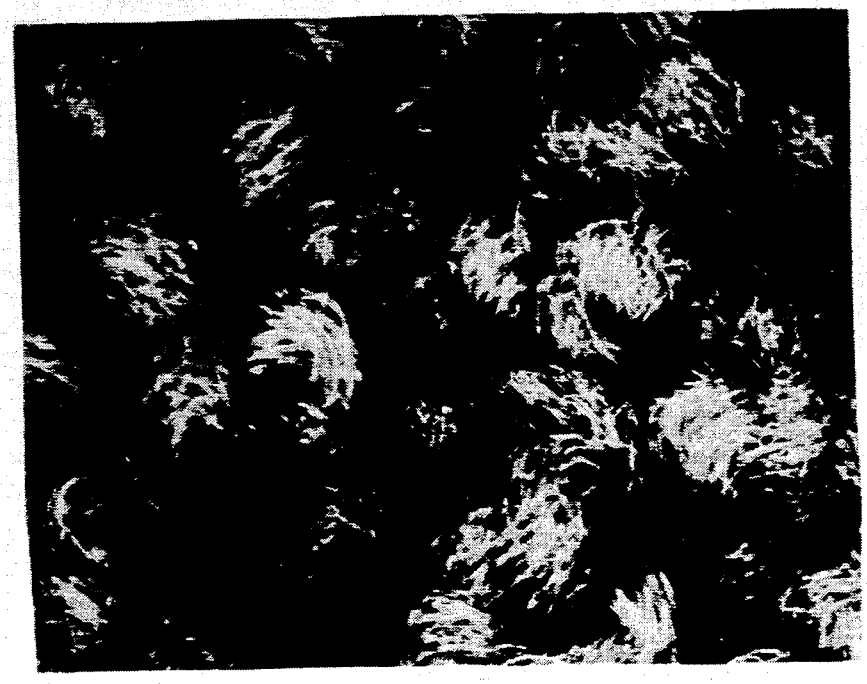
FIG. 2 is a face view of a carpet having a surface texture between the frieze texture and the textures depicted in FIGS. 3 and 4, with a Visual Rating of 2.
Figure 5:
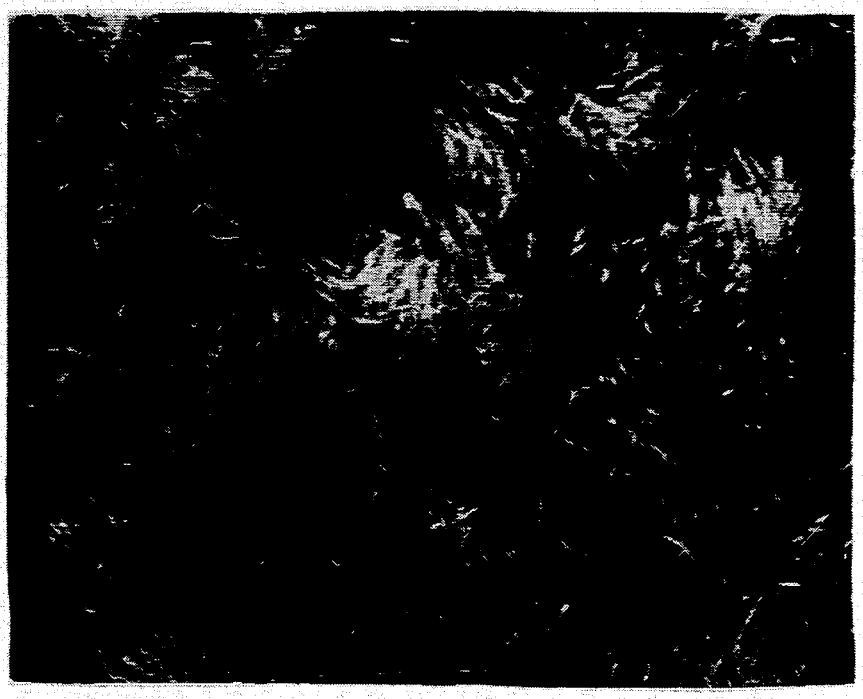
FIG. 5 is a face view of a carpet having a surface texture between the tightly tailored texture and the textures depicted in FIG. 6, with a Visual Rating of 5.
Figure 6:
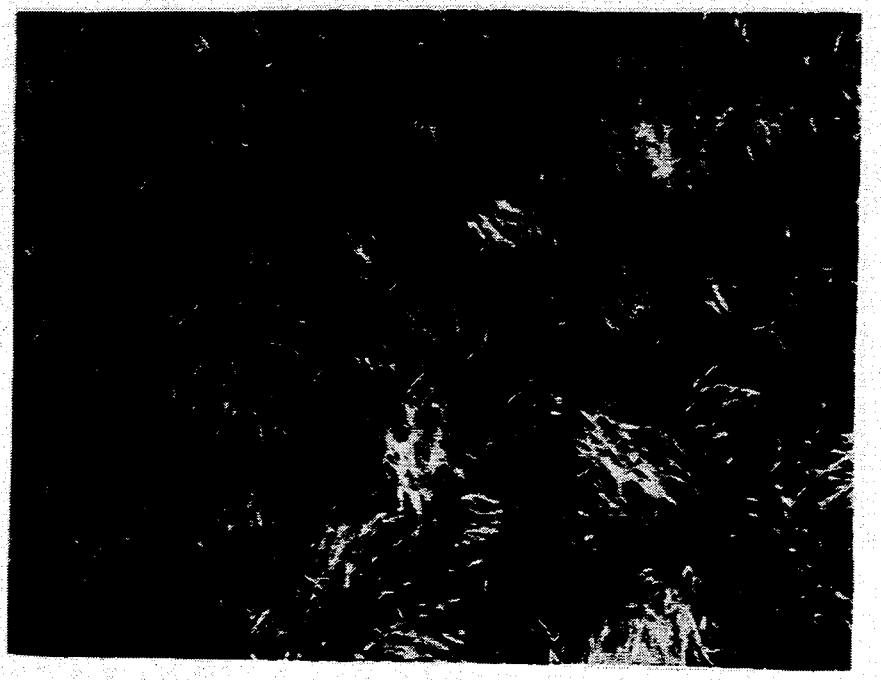
FIG. 6 is a face view of a carpet having a loose surface texture, with open tuft tips forming a brush-like appearance, and a Visual Rating of 6.

In contrast, textured carpets having a substantial amount of highly kinked tuft structures that demonstrate gross buckling are shown in FIGS. 1 and 2. These carpets have respective ratings of 1 and 2 on the Visual Rating Scale. In addition, textured carpets having a loose surface texture, with a substantial amount of open tuft tips forming a brush-like appearance, are shown in FIGS. 5 and 6. These carpets have respective ratings of 5 and 6 on the Visual Rating Scale.

The invention is further illustrated by the following examples, but these examples should not be construed as limiting the scope of the invention.

Testing Methods

Visual Rating Scale

The surface texture of various carpet samples were visually compared in a side-by-side comparison without knowledge of which carpets were made from which yarns. The carpets were examined by a panel of people familiar with carpet construction and surface textures. The carpets were given a rating of 1 to 6. Ratings were based on the overall surface texture of the carpet based on such factors as twist level, structure, and integrity, presence of compact helical curls at tuft tips, and/or gross buckling of tuft structures. Those carpets having a loose surface texture with a substantial amount of open tuft tips, as shown in FIGS. 5 and 6, were given a rating between 5 to 6. Those carpets having a tightly tailored surface texture, as shown FIGS. 3 and 4, were given a rating between 3 to 4. Those carpets having a surface texture with a substantial amount of highly kinked tuft structures which demonstrated gross buckling, as shown in FIGS. 1 and 2, were given a rating between 1 to 2. It is recognized that some judgment must be exercised in rating various surface textures according to this scale.

Measurement of Ply-Twist Level in Yarns (Turns Per Inch)

The ply-twist level of the yarns, in turns per inch (tpi), was measured on a Precision Twist Tester manufactured by Alfred Suter Co., Inc., Orangeburg, N.Y., U.S.A. A convenient length of the yarn was mounted into the twist counter and tensioned with approximately 0.1 grams per denier (gpd) force. The twist counting mechanism of the instrument was set to zero and the rotatable clamp was turned until all the twist of the individual singles yarns in the ply-yarn were removed. The removal of the twist was verified by moving a stylus between the singles yarns. The twist level in turns per inch was then computed by the following formula.

$$\text{Twist Level (turns/inch)} = \frac{\text{Turns to remove twist}}{\text{Initial length of ply-yarn}}$$

Measurement of Yarn Bulk

Yarn bulk was measured using the method described in Robinson & Thompson, U.S. Pat. No. 4,295,252, the disclosure of which is incorporated herein for reference. The yarn bulk levels are reported herein as % bulk crimp elongation (% BCE) as described in Robinson & Thompson. The bulk measurements were made at 11 m/min for 1.5 minutes using a sample length of 16.5 meters. The tensioning weight used was 0.1 gram/denier (0.11 g/dtex). The pressure of the air in the heating chamber was 0.05 inches of water, and the temperature of the heating air was 170°±3° C.

EXAMPLES

EXAMPLE 1

In this example, a quantity of carpet yarn was heat-treated by the process of this invention and carpets were manufactured from these heat-treated yarns.

The singles yarn used was commercially available 1480 denier high bulk (35% BCE) nylon 6,6 bulked continuous filament (BCF), sold by E. I. du Pont de Nemours and Company, Wilmington, Del., U.S.A., as 1480/P943, "Fiber for Stainmaster$^{cm}$ Carpets." The cabling operation was done on a direct cabling machine commonly used in the trade to prepare such yarns. The ply-twist level of the yarn was 4.03 turns/inch (tpi).

The yarn was processed by passing it through the steam tube shown schematically in FIG. 7 which added moisture to and increased the temperature of the yarn. The yarn was then fed into a stuffer box, commercially available from Superba Co., Mulhouse, France, Model No. MF. No steam was injected into the stuffer box. The yarn was then fed through a standard commercial configuration Superba® carpet yarn heat-setting machine fitted with a pre-bulker, heat-setting chamber, dryer and wind-ups, commercially available from Superba Co., Model No. TVP. Twelve (12) yarn ends were run through the above described process at a yarn speed of 144 m/min which was about 35 kg/hour yarn throughput.

The steam tube was mounted such that the yarn outlet end was about 2.5 cm from the stuffer box entrance. The apparatus was 0.47 m long with an inner diameter of 0.64 cm. The residence time of the volume of yarn in the steam tube was about 0.2 seconds, and the yarn was heated to a temperature of about 50° C. and saturated with water. The stuffer box was run at standard operating conditions which included a gate setting of 5 on the arbitrary scale provided on the device. Belt speed through the pre-bulker, heat-setting chamber and dryer was 6 m/min. The residence time in the heat-setting chamber was about 60 seconds. The heat-setting chamber was run at 2.15 Bar and at 132° C.

Cut pile carpet samples were made using standard carpet ⅛ inch gauge tufting equipment. The carpets had a face fiber weight of 36 oz./sq. yd. and a 9/16th inch finished pile height. After tufting, the carpets were dyed on a Kuster continuous dyeing apparatus. After dyeing, the carpets were latexed by standard procedures and twice sheared on standard carpet shearing equipment.

The carpet samples were evaluated by the Visual Rating Scale and the results are shown in Table I.

Comparative Example A

In this comparative example, carpet yarn was treated in the same manner as described in Example 1, except the yarn was not heated and moisturized prior to entering the stuffer box. Like the process described in Example 1, no steam was injected into the stuffer box.

The singles yarn used was 1420 denier high bulk (34% BCE) nylon 6,6 bulked continuous filament (BCF) test yarn which is similar to the yarn used in Example 1.

Carpet samples were made by the techniques described in Example 1 and evaluated by the Visual Rating Scale. The results are shown in Table I.

Comparative Example B

In this comparative example, carpet yarn was treated in the same manner as described in Example 1, with the following differences: 1) the yarn was not heated and moisturized prior to entering the stuffer box, and 2) steam was injected into the stuffer box as the yarn passed through the box.

The singles yarn used was 1420 denier high bulk (34% BCE) nylon 6,6 bulked continuous filament (BCF) test yarn which is similar to the yarn used in Example 1.

Carpet samples were made by the techniques described in Example 1 and evaluated visually, but could not be placed on the Visual Rating Scale as the tufts were severely distorted and the tuft twist was unraveled. The results are shown in the following Table I.

TABLE I

| Example No. | Visual Rating |
|---|---|
| 1 | 3.5 |
| A (Comparative) | 4.5 |
| B (Comparative) | overtextured with unraveled tufts |

EXAMPLE 2

In this example, a quantity of carpet yarn was heat treated and evaluated in the same manner as described in Example 1, except for the differences specified below.

The singles yarn used was commercially available 1410 denier medium bulk (21% BCE) nylon 6,6 bulked continuous filament (BCF), sold by E. I. du Pont de Nemours and Company, Wilmington, Del., U.S.A., as 1410/696AS, "Fiber for Stainmaster$^{cm}$ Carpets." The ply-twist level of the yarn was 3.78 turns/inch (tpi). Twelve (12) yarn ends were run through the process described above at a yarn speed of 152 m/min. This was about 35 kg/hour throughput.

The steam tube was mounted such that the yarn outlet end was about 2.5 cm from the stuffer box entrance. The steam tube was 0.47 m long with an inner diameter of 0.64 cm. The residence time of the volume of yarn in the steam tube was about 0.2 seconds, and the yarn was heated to a temperature of about 50° C. and saturated. The stuffer box was run at standard operating conditions which included a gate setting of 5 on the arbitrary scale provided on the device. No steam was injected into the stuffer box. Belt speed through the pre-bulker, heat-setting chamber and dryer was 6 m/min. The residence time in the heat-setting chamber was about 60 seconds. The heat setting chamber was run at 2.15 bar and at 132° C.

Carpet samples were made by the techniques described in Example 1 and evaluated by the Visual Rating Scale. The results are shown in the following Table II.

Comparative Example C

In this comparative example, carpet yarn was treated in the same manner as described in Example 2, except the yarn was not heated and moisturized prior to entering the stuffer box. Like the process described in Example 2, no steam was injected into the stuffer box.

The singles yarn used was commercially available 1410 denier medium bulk (21% BCE) nylon 6,6 bulked continuous filament (BCF), sold by E. I. du Pont de Nemours and Company, Wilmington, Del., U.S.A., as 1410/696AS, "Fiber for Stainmaster$^{cm}$ Carpets" and was from the same supply of yarn used in Example 2.

Carpet samples were made by the techniques described in Example 1 and evaluated by the Visual Rating Scale. The results are shown in the following Table II.

Comparative Example D

In this comparative example, carpet yarn was treated in the same manner as described in Example 2, with the following differences: 1) the yarn was not heated and moisturized prior to entering the stuffer box, and 2) steam was injected into the stuffer box as the yarn passed through the box.

The singles yarn used was commercially available 1410 denier medium bulk (21% BCE) nylon 6,6 bulked continuous filament (BCF), sold by E. I. du Pont de Nemours and Company, Wilmington, Del., U.S.A., as 1410/696AS, "Fiber for Stainmaster$^{cm}$ Carpets" and was from the same supply of yarn used in Example 2.

Carpet samples were made by the techniques described in Example 1 and evaluated visually, but could not be placed on the Visual Rating Scale as the tufts were severely distorted and the tuft twist was unraveled. The results are shown in the following Table II.

TABLE II

| Example No. | Visual Rating |
|---|---|
| 2 | 5 |
| C (Comparative) | 5.5 |
| D (Comparative) | overtextured with unraveled tufts |

EXAMPLE 3

In this example, a quantity of carpet yarn was heat treated and evaluated in the same manner as described in Example 1, except for the differences specified below.

The singles yarn used was commercially available 1480 denier high bulk (35% BCE) nylon 6,6 bulked continuous filament (BCF) yarn, sold by E. I. du Pont de Nemours and Company, Wilmington, Del., U.S.A., as 1480/P943, "Fiber for Stainmaster$^{cm}$ Carpets." The ply-twist level of the yarn was 3.50 turns/inch (tpi). Twelve (12) yarn ends were run through the process described above at a yarn speed of 148 m/min. This was about 36 kg/hour yarn throughput.

The steam tube was mounted such that the yarn outlet end was about 2.5 cm from the stuffer box entrance. The steam tube was 0.47 m long with an inner diameter of 0.64 cm. The residence time of the volume of yarn in the steam tube was about 0.2 seconds, and the yarn was heated to a temperature in the range of about 65° to 80° C. and saturated. The stuffer box was run at standard operating conditions which included a gate setting of 7.5 on the arbitrary scale provided on the device. No steam was injected into the stuffer box. Belt speed through the pre-bulker, heat-setting chamber and dryer was 6 m/min. The residence time in the heat-setting chamber was about 60 seconds. The heat-setting chamber was run at 2.15 bar at 129° C.

Carpet samples were made by the techniques described in Example 1 and evaluated by the Visual Rating Scale. The results are shown in Table III.

Comparative Example E

In this comparative example, carpet yarn was treated in the same manner as described in Example 3, except the yarn was not heated and moisturized prior to entering the stuffer box. Like the process described in Example 3, no steam was injected into the stuffer box.

The singles yarn used was 1480 denier high bulk (35% BCE) nylon 6,6 bulked continuous filament (BCF) yarn, sold by E. I. du Pont de Nemours and Company, Wilmington, Del., U.S.A., as 1480/P943, "Fiber for Stainmaster$^{cm}$ Carpets", and was from the same supply of yarn used in Example 3.

Carpet samples were made by the techniques described in Example 1 and evaluated by the Visual Rating Scale. The results are shown in the following Table III.

TABLE III

| Example No. | Visual Rating |
|---|---|
| 3 | 3.5 |
| E (Comparative) | 4.5 |

We claim:

1. A process for treating a ply-twisted crimped multifilament yarn, comprising the steps of:
   a) forming a ply-twisted crimped multifilament yarn comprising two or more singles yarns;
   b) impinging the ply-twisted yarn with a heated fluid such that the yarn is saturated with water and heated;
   c) removing excess heated fluid from the saturated yarn prior to passing the saturated yarn through a stuffing chamber, said yarn having a temperature in the range of 40° to 90° C. immediately prior to being passed through said stuffing chamber, and
   d) passing the yarn through said stuffing chamber, wherein the yarn is axially compressed to impart helical compression deformations into the filaments, said stuffing chamber being essentially free of steam.

2. The process of claim 1, further comprising the step of passing the yarn through a heat-setting chamber, wherein the twist is heat-set, subsequent to passing the yarn through the stuffing chamber.

3. The process of claim 2, wherein the twist is heat-set by treating the yarn with pressurized saturated steam.

4. The process of claim 2, wherein the twist is heat-set by treating the yarn with dry heat.

5. The process of claim 1, wherein the yarn is impinged with saturated steam such that the yarn is saturated with water and heated.

6. The process of claim 1, wherein the yarn is a nylon yarn.

7. The process of claim 6, wherein the yarn is nylon 6,6.

8. The process of claim 1, wherein the yarn is a continuous multifilament yarn.

9. The process of claim 1, wherein the yarn is a staple spun yarn.

* * * * *